United States Patent [19]

Hummel et al.

[11] Patent Number: 4,827,794

[45] Date of Patent: May 9, 1989

[54] WINDOW CRANK EXTENSION

[76] Inventors: Richard A. Hummel, 214 S. 1st, Red Oak, Iowa 51566; George Specter, 233 Broadway, Rm. 3815, New York, N.Y. 10007

[21] Appl. No.: 126,463

[22] Filed: Nov. 30, 1987

[51] Int. Cl.[4] ..... G05G 1/10

[52] U.S. Cl. ..... 74/543; 74/544; 74/548; 74/545; 16/110 R; 403/3

[58] Field of Search ..... 74/548, 545, 544, 543, 74/546; 403/3, 4, 260, 258, 287; 292/347, 356, 357, 350; 16/110 R, 115

[56] References Cited

U.S. PATENT DOCUMENTS

| | | | |
|---|---|---|---|
| 1,408,908 | 3/1922 | Roth | 74/545 |
| 1,517,116 | 11/1924 | Hank | 74/544 |
| 1,611,549 | 12/1926 | Moore | 292/347 |
| 1,633,183 | 6/1927 | Koeb | 292/356 |
| 1,735,897 | 11/1929 | Edgar | 74/545 |
| 2,163,101 | 6/1939 | Newton | 292/356 |
| 3,222,951 | 12/1965 | Maursey | 74/543 |
| 4,117,568 | 10/1978 | Bullock | 74/543 |

FOREIGN PATENT DOCUMENTS

| | | | |
|---|---|---|---|
| 2343933 | 3/1975 | Fed. Rep. of Germany | 292/356 |
| 643373 | 1/1979 | U.S.S.R. | 16/110 R |

*Primary Examiner*—Rodney M. Lindsey
*Assistant Examiner*—Flemming Saether

[57] ABSTRACT

A window crank handle extension adapter for a motor vehicle is provided and consists of a spacer member that will allow the crank handle to extend away from a speaker mounted within a door panel of the motor vehicle so that a person can turn the crank handle without hitting the cover of the speaker.

3 Claims, 1 Drawing Sheet

WINDOW CRANK EXTENSION

BACKGROUND OF THE INVENTION

The instant invention relates generally to control handles and more specifically it relates to a window crank handle extension adapter for a motor vehicle.

Numerous control handles have been provided in prior art that are adapted to contain extended shafts outwardly that are manually rotated thereabout. For example, U.S. Pat. Nos. 2,829,538 3,605,521 and 3,902,152 all are illustrative of such prior art. While these units may be suitable for the particular purpose to which they address, they would not be as suitable for the purposes of the present invention as heretofore described.

SUMMARY OF THE INVENTION

A primary object of the present invention is to provide a window crank handle extension adapter for a motor vehicle that will overcome the shortcomings of the prior art devices.

Another object is to provide a window crank handle extension adapter for a motor vehicle that will allow the crank handle to extend away from a high wattage stereo speaker added to door of the motor vehicle so that a person can operate the crank handle without interference.

An additional object is to provide a window crank handle extension adapter for a motor vehicle that is self adjustable to the door of the motor vehicle.

A further object is to provide a window crank handle extension adapter for a motor vehicle that is simple and easy to use.

A still further object is to provide a window crank handle extension adapter for a motor vehicle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of th appended claims.

BRIEF DESCRIPTION OF THE DRAWING FIGURES

DETAILED DESCRIPTION OF THE PREFERRED EMBODIMENTS

Figure 1:
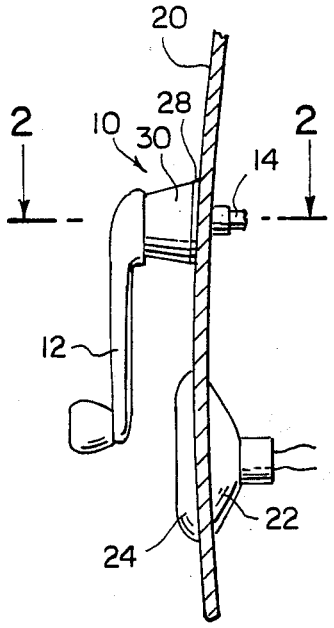
FIG. 1 is a side view of the invention in use with a window crank handle of a motor vehicle.
Figure 2:
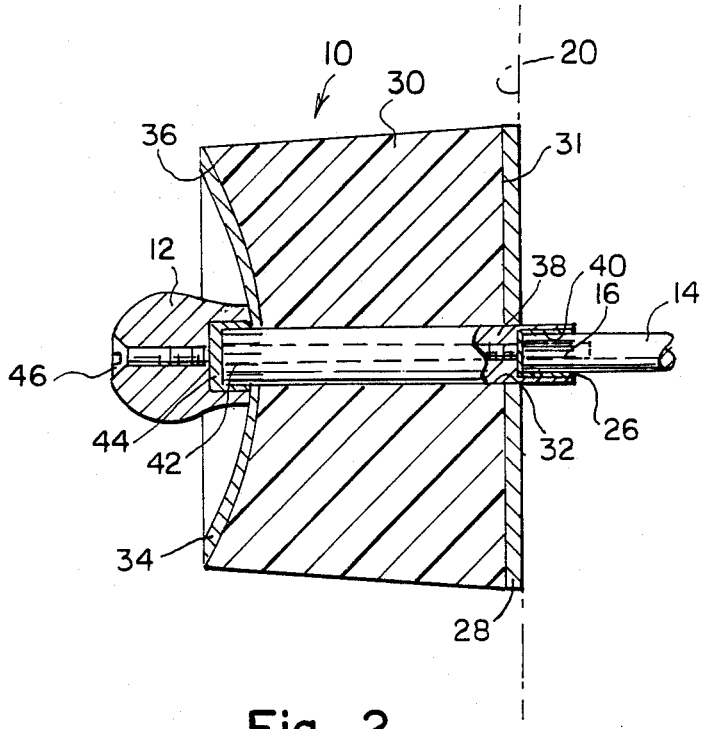
FIG. 2 is an enlarged cross sectional view taken along line 2—2 i FIG. 1.

Turning now descriptively to the drawings, in which similar reference characters denote similar elements throughout the several views, FIGS. 1 and 2 illustrate an extension adapter 10 for a window crank handle 12 and crank shaft 14 that has a splined end 16 in a motor vehicle door panel 20 with a high voltage stereo speaker 22 and cover 24 installed therein. The extension adapter 10 consists of a first splined insert 26 that has a hole therethrough placed onto the splined end 16 of the crank shaft 14. A rear flat washer 28 is placed against the door panel 20 in alignment with the first splined insert 26 and the crank shaft 14. A concave truncated cone-shaped spacer member 30 has a central aperture 32 therethrough. Flat end 31 of the spacer member 30 is placed in alignment against the rear flat washer 28. A front curved washer 34 is placed in alignment against the concave truncated end 36 of the spacer member 30.

An elongated hollow shaft 38 that has a female splined end 40 and a male splined end 42 extends through the central aperture 32 in the spacer member 30 with the female splined end 40 fitting over the first splined insert 26 and the male splined end 42 extending past the front curved washer 34. A second splined insert 44 that has a hole therethrough is placed onto the male splined end 42 of the elongated shaft 38 and against the front curved washer 34 with the window crank handle 12 fitting over the second splined insert 44. An elongated screw 46 extends through the window crank handle 12, the second splined insert 44, the elongated hollow shaft 38 and the first splined insert 26 to threadably engage with the crank shaft 14, allowing the crank handle 12 to extend outwardly away from the speaker 22 mounted within the motor vehicle door panel 20 so that a person (not shown) can turn the crank handle 12 without hitting the cover 24 of the speaker 22.

Figure 3:
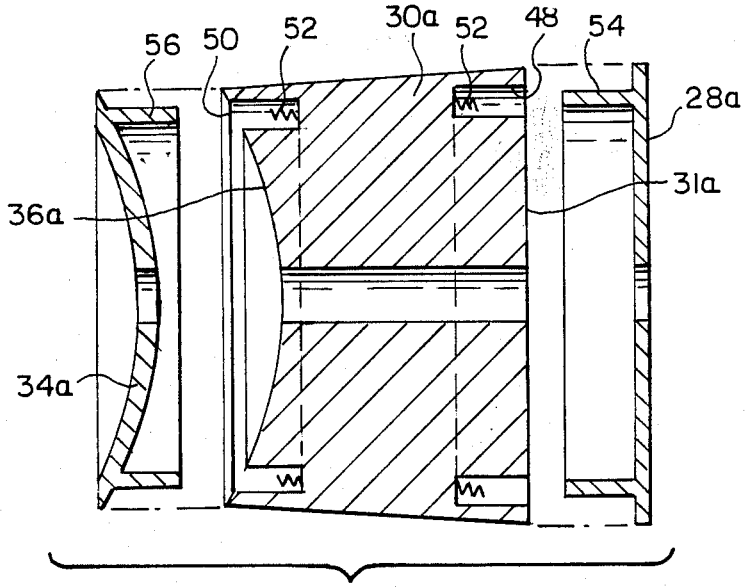
FIG. 3 is an enlarged partly exploded cross sectional view similar to FIG. 2 of a modification in which the front and rear spacing washers each include an annular flange so as to be spring biased to the spacer member for adjustment thereto.

FIG. 3 shows a modification in which the spacer member **30*a* has a first annular groove 48 within the flat end 31*a* thereof and a second annular groove 50 within the concave truncated end 36*a*. A pair of annular springs 52 are each mounted within one of the annular grooves 48 and 50 in the spacer member 30*a*. A first annular flange 54 is formed on the rear flat washer 28*a* and is inserted into the first annular groove 48 in the spacer member 30*a* to bear against one of the springs 52. A second annular flange 56 is formed on the front curved washer 34*a* and is inserted into the second annular groove 50 in the spacer member 30*a* to bear against other of the springs 52 so that the extension adapter is self adjustable when installed on the door panel 20**.

Figure 4:
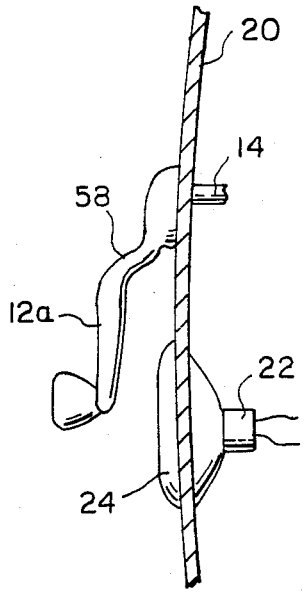
FIG. 4 is a side view similar to FIG. 1 showing a new reshaped window crank handle to replace the old window crank handle and extension adapter.

As shown in FIG. 4, a new window crank handle **12*a* is reshaped to have a bend 58 in it to clear the cover 24 of the speaker 22 in the door panel 20. The new window crank handle 12*a* could be sold separately to replace the original old crank handle 12 and the use of the extension adapter 10**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An extension adapter for a window crank handle and crank shaft having a splined end in a motor vehicle door panel, said extension adapter comprising:

(a) a first splined insert having a holder therethrough placed onto the splined end of the crank shaft;

(b) a rear flat washer placed against the door panel in alignment with said fist splined insert and the crank shaft;

(c) a concave truncated cone-shaped spacer member having a central aperture therethrough, flat a end of said spacer member placed in alignment against said rear flat washer;

(d) a front curved washer placed in alignment against a concave truncated end of said spacer member;

(e) an elongated hollow shaft having a female splined end and a male splined end, said shaft extending through the central aperture in said spacer member with the female splined end extending through said rear flat washer and fitting (f) a second splined insert having a hole therethrough placed onto the male splined end of said elongated shaft and against the front curved washer with the window crank handle fitting over said second splined insert; and (g) a screw extending through the window crank handle, said second splined insert, said elongated hollow shaft and said first splined insert to threadably engage with the crank shaft, allowing the crank handle to extend outwardly away from the motor vehicle door panel so that a person can turn the crank handle unobstructed.

2. An extension adapter as recited in claim 1 further comprising:

(a) said spacer member having a first annular groove within the flat end thereof and a second annular groove within the concave truncated end;

(b) a pair of annular springs, each mounted within one of the annular grooves in said spacer member;

(c) a first annular flange formed on said rear flat washer inserted into said first annular groove in said spacer member to bear against one of said springs; and (d) a second annular flange formed on front curved washer inserted into said second annular groove in said spacer member to bear against the other of said springs so that said extension adapter is self adjustable when installed on the door panel.

3. An adapter as in claim 1, including means for adjustably mounting said washers relative to said spacer member whereby the location of said spacer member along said elongated shaft hollow is a function of the distance said screw is threaded into said crank shaft.

* * * * *